United States Patent [19]

Scott

[11] 4,418,906

[45] Dec. 6, 1983

[54] SHEET STOCK TRANSFER APPARATUS

[75] Inventor: Richard H. Scott, Columbus, Ohio

[73] Assignee: Western Electric Company, Inc., New York, N.Y.

[21] Appl. No.: 315,805

[22] Filed: Oct. 28, 1981

[51] Int. Cl.[3] ..... B65H 3/08

[52] U.S. Cl. ..... 271/99; 271/107

[58] Field of Search ..... 271/99, 100, 101, 102, 271/107

[56] References Cited

U.S. PATENT DOCUMENTS

| | | | |
|---|---|---|---|
| 270,671 | 1/1883 | Huffer . | |
| 2,075,169 | 3/1937 | Brown . | |
| 2,079,080 | 5/1937 | Melind . | |
| 3,797,822 | 3/1974 | Anderson | 271/107 X |
| 3,937,458 | 2/1976 | Langen . | |
| 4,322,067 | 3/1982 | Masselin | 271/99 |

*Primary Examiner*—Richard A. Schacher

*Attorney, Agent, or Firm*—K. R. Bergum; R. P. Miller

[57] ABSTRACT

A sheet stock transfer apparatus (10) is adapted to successively extract the lowermost sheet (22) of a stack thereof, while initially releasably confined within an elevated magazine (23) at a dispensing station, and to thereafter invert each such extracted sheet while being transferred to, and subsequently precisely positioned within, an underlying workholder (26) of an associated indexably advanced turret (27), for example, at a receiving station. This sequence of operations is accomplished through the use of both a specially constructed rack (11) and a pinion assembly (12). The rack is formed with an intermediate section with teeth and two opposite end sections without teeth. The pinion assembly includes a peripherally segmented and partially rotatable pinion (14), mounted on a hollow shaft (16), and being retractably driven along the rack in response to an indirectly coupled cam-controlled pneumatic cylinder (21), with a pick-up arm (18) fixedly secured at one end to the hollow shaft (16), and a sequentially operated vacuum cup (19) secured to the other (outer) end of the pick-up arm. As the pinion (14) is reciprocally driven along the rack (11), uniquely formed transition notches (**11*e*, 11*f*) in the rack (11) and selective outer transition corners (14*a*′, 14*a*″ or 14*b*′, 14*b*″) formed in flat portions (14*a* or 14*b*) of the pinion (14) cooperate to sequentially effect linear- to compound linear and rotational-to linear displacement of the pinion, together with the pick-up arm (18) and vacuum cup (19**). As thus constructed, the apparatus is particularly adapted to rapidly and reliably extract, transfer and position sheets that are very thin and/or of relatively fragile material.

15 Claims, 7 Drawing Figures

SHEET STOCK TRANSFER APPARATUS

FIELD OF THE INVENTION

This invention relates to piece-part handling apparatus and, more particularly, to such apparatus of the type for successively transferring sheets of a supply thereof from a dispenser station to a receiving station in a rapid, repetitive manner.

BACKGROUND OF THE INVENTION

Several well-known types of apparatus have been employed heretofore for successively feeding or transferring piece-parts having planar surfaces, and particularly such parts when of sheet configuration, from a magazine-loaded supply thereof at a dispensing station to a workholder or nest at a receiving or work station.

One type of such apparatus has comprised a cross-slide actuated feed member or finger that is adapted to initially contact an outer edge of each successive lowermost sheet of a magazine-confined stack thereof, and to thereafter laterally displace each such sheet through a sidewall slot formed in the magazine to a receiving or work station normally positioned in close proximity to the magazine. While such an apparatus generally is of simplified and inexpensive construction, it is often inapplicable for use in situations where the sheets to be transferred are very thin and/or of fragile material, such as of writing paper thickness and/or rigidity. This is true even when some form of guide rails or channels are employed to facilitate the lateral displacement of the sheets.

A second type of sheet stock transfer apparatus employed heretofore has included a vacuum pick-up assembly coupled to a rotary transfer mechanism, the latter typically comprising a planetary gear assembly. One form of this latter type of apparatus has employed two diametrically disposed vacuum cups that are simultaneously advanced between different points of an essentially triangular closed-loop path having inwardly bowed sides, with two of the verticies defining the locations of the dispensing and receiving stations. Such an apparatus is disclosed in M. J. M. Langen U.S. Pat. No. 3,937,458.

While this latter type of apparatus is normally applicable for use in transferring diverse types of sheet stock, regardless of the thickness and/or rigidity thereof, the aforementioned planetary gear assembly employed therein is quite complex, and does not allow for precisely controlled linear displacement of the vacuum cups as they approach and are withdrawn from either the dispensing or receiving stations. Such sequentially controlled linear displacements of a vacuum cup are often desired, if not required, when precise positioning of transferred sheet stock is required at the receiving station, and particularly when the extraction, transfer and placement operations are performed at relatively high repetitive speeds, such as in conjunction with successively aligned workholders on a rapidly indexed turret.

It is also often desirous that the linear displacements in question be co-linear so as to allow the sheet stock dispensing and receiving stations to be vertically aligned. This may often be of particular importance when space requirements are at a premium, such as when the transfer apparatus is but one of a plurality of closely spaced instrumentalities that perform a succession of work functions on a given piece part during the fabrication thereof.

There has thus been a need for an inexpensive, simplified and reliable sheet stock transfer apparatus that is applicable for use in handling diverse types of material sheets, regardless of the thickness and/or rigidity thereof, and wherein precisely controlled linear-to compound linear and rotational-to linear displacement is imparted to each successive sheet during the transfer operation.

SUMMARY OF THE INVENTION

In accordance with the principles of the present invention, a preferred embodiment of a sheet stock transfer apparatus is adapted to successively extract, in a rapid repetitive manner, each successive lowermost sheet of a stack thereof, as releasably confined within an elevated magazine at a dispensing station, and to thereafter invert each such extracted sheet while being transferred to, and subsequently precisely positioned within, an underlying nest or workholder located at a receiving station, such as defined on an associated indexably advanced turret. p This unique sequence of sheet stock handling operations is accomplished through the use of both a specially constructed rack and a pinion assembly. The rack is formed with an intermediate section with teeth and two opposite end sections without teeth. The pinion assembly includes a peripherally segmented and partially rotatable pinion secured to a hollow shaft, with a hollow pick-up arm fixedly secured at one end to the shaft. The opposite end of the pick-up arm has a sequentially operated vacuum cup secured thereto. The composite pinion assembly is mounted and coupled to a drive source such that the pinion is reciprocally driven along the rack while in continuous engagement therewith.

As the pinion is thus being driven, unique transition regions formed in both the rack and pinion cooperate to sequentially effect vertically oriented linear-to compound linear and rotational-to vertically oriented linear displacement of the pinion, together with the pick-up arm and vacuum cup associated therewith, as required for one particular sheet stock transfer application involving thin, relatively fragile sheets of insulative material.

DETAILED DESCRIPTION OF THE INVENTION

It should be appreciated that while the invention is described in detail herein primarily for use in transferring thin sheets of adhesive-backed, and specially treated, insulative paper from a dispensing station to a receiving station, as required in the fabrication of one particular type of wire-wound resistor, the rack and pinion assembly incorporated in the composite apparatus is also applicable for use in many other applications involving the transfer of diverse piece-parts, whether of sheet stock configuration or not, and in many of such cases optionally allowing the use of pick-up instrumentalities other than of the vacuum type. For example, in the case of transferring feromagnetic articles, the pick-up assembly could be of the electromagnetic type. Alternatively, the pick-up assembly could also be comprised of actuable, frictionally engaging clamping members or jaws when the piece parts to be transferred have appreciable thickness and rigidity.

Figure 1:
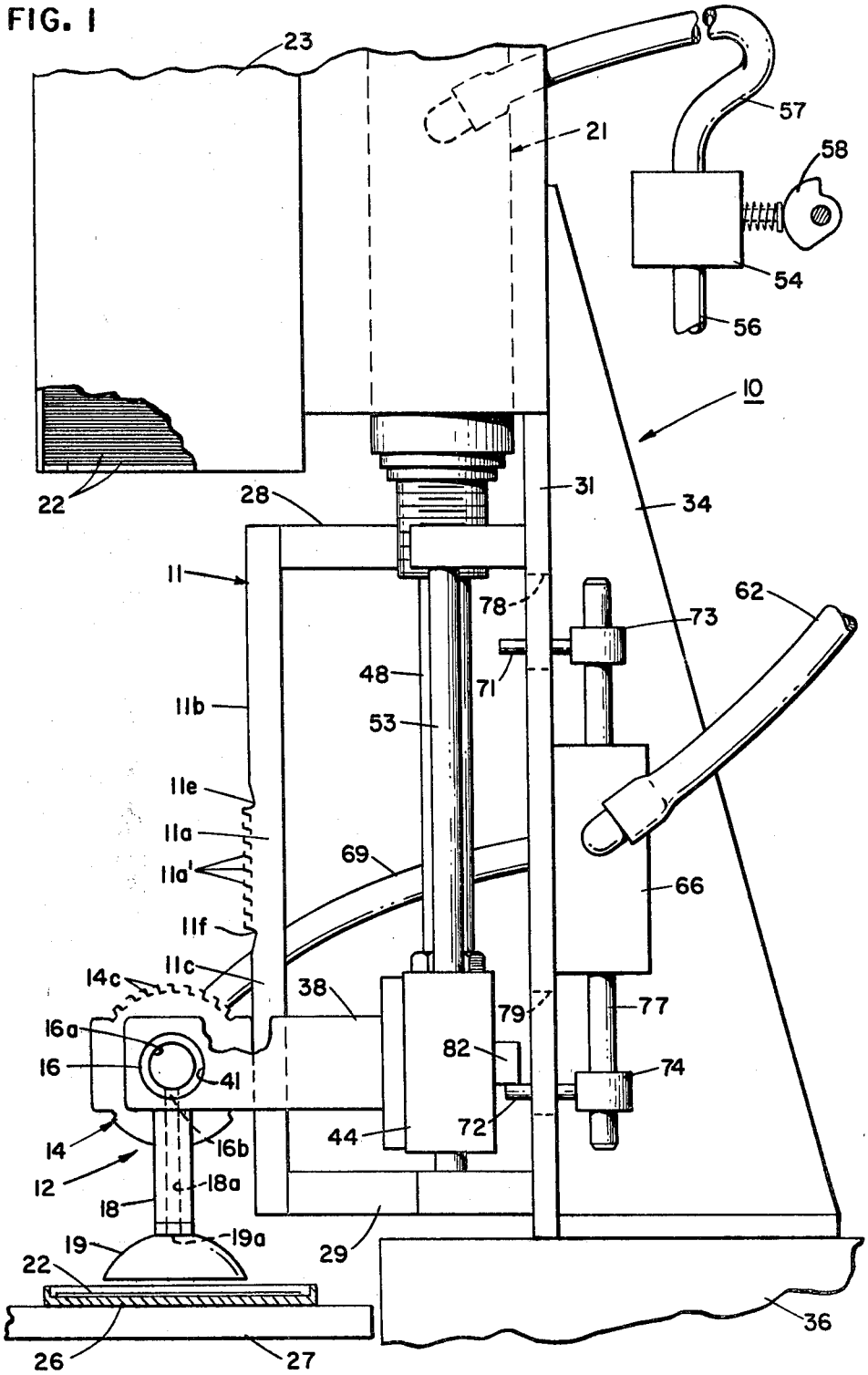
FIG. 1 is a fragmentary side elevational view, partially in section, illustrating a sheet stock transfer apparatus embodying the principles of the present invention.
Figure 3:
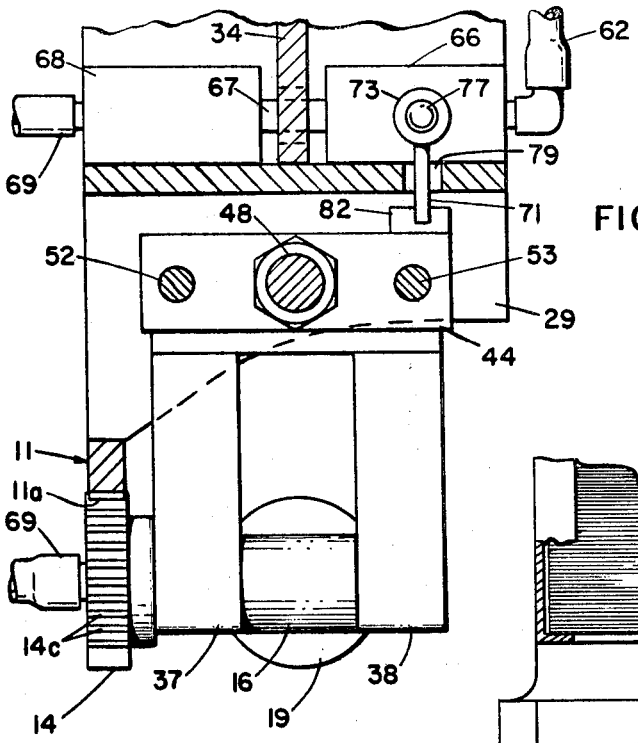
FIG. 3 is a fragmentary, cross-sectional view of the apparatus of FIG. 1, taken along the line 3—3 of FIG. 2, illustrating in greater detail the physical relationship of certain structural features of the apparatus depicted selectively in FIGS. 1 and 2, and FIGS. 4–7 are related fragmentary side elevational views, illustrating in greater detail the orientation of the pinion assembly, relative to the associated rack, at different progressive stages during a typical sheet stock transfer cycle effected with the composite apparatus depicted in FIGS. 1 and 2.
Figure 2:
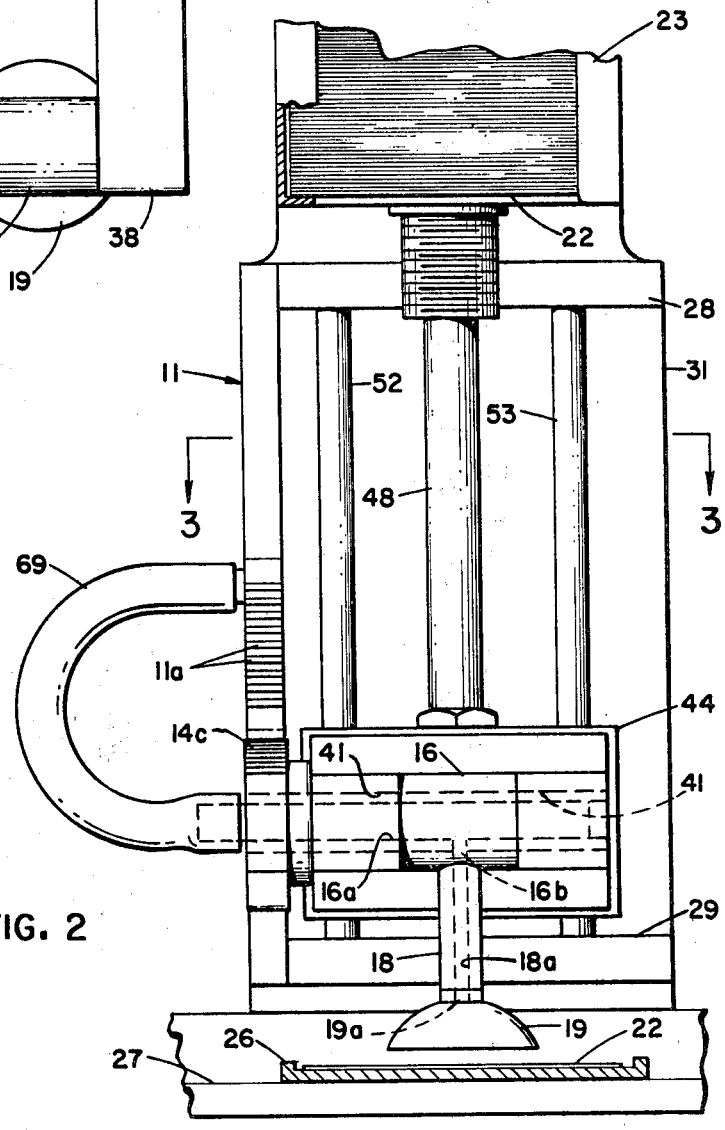
FIG. 2 is a fragmentary front elevational view, partially in section, of the apparatus of FIG. 1.

With reference first to FIGS. 1–3, there is shown a composite sheet stock transfer apparatus 10 which includes both a uniquely constructed rack 11 and a pinion assembly 12, the latter including a peripherally segmented pinion 14 secured to one end of a rotatably mounted hollow shaft 16 (best seen in FIGS. 2 and 3). A hollow pick-up arm 18 is secured at one end to the shaft 16, with the opposite end of the former having a sequentially operated vacuum cup 19 secured thereto.

In accordance with the principles of the present invention, the specially constructed rack 11 and pinion 14 are adapted to cooperate, in response to the latter being reciprocally driven along the rack under the control of a pneumatic air cylinder 21, to allow the vacuum cup 19 to initially extract the then lowermost sheet 22 of a stacked supply thereof while releasably confined within an elevated magazine 23. Thereafter, the pinion-controlled vacuum cup effects the inversion of the previously extracted sheet 22 while the latter is transferred along an arcuate path to, and subsequently precisely positioned within, an underlying nest or workholder 26. As illustrated, the workholder 26 represently only one of a plurality of circumferentially spaced workholders positioned on an indexably advanced turret 27 (shown only in fragmentary form).

It is understood, of course, that the workholders 26 may take many other forms, and be a part of other types of associated apparatus, such as an indexable conveyor. Alternatively, a single workholder 26 may simply form a part of a single stationary work station. In any event, the structural nature of the receiving or work station is incidental to an understanding of the construction and mode of operation of the transfer apparatus 10 of primary concern herein.

Considering the unique construction of the rack 11 and pinion 14 now in greater detail, and with particular reference to FIG. 1, it is seen that the rack includes an intermediate portion 11*a* formed with a plurality of teeth 11*a'*, and two associated toothless end sections 11*b* and 11*c*. In accordance with the principles of the present invention, two pecularily formed transition regions, comprised of specially contoured notches 11*e* and 11*f* are also formed in the rack 11 immediately adjacent the upper and lower ends, respectively, of the intermediate section 11*a* with teeth.

As for the pinion 14, it is formed with two mutually disposed flat portions 14*a* and 14*b*, with each portion defining opposite end transition regions in the form of corners 14*a'*, 14*a''* or 14*b'*, 14*b''*. In the illustrative embodiment, only one of the two peripheral regions of the pinion 14 defined between the two flat portions 14*a* and 14*b* is formed with a circumferentially disposed array of teeth 14*c*, as an opposite side array of teeth would serve no beneficial purpose in the illustrative operating example, and would increase the costs of machining the pinion.

As best seen in FIGS. 4–7, the transition-defining notches 11*e* and 11*f* of the rack 11 selectively cooperate with the outer transition corners 14*a'*, 14*a''* and 14*b*, 14*b''* of the pinion to effect the desired linear-to compound linear and rotational-to linear displacement of the composite pinion assembly 12 while the pinion thereof is reciprocally driven along the rack in a manner described in greater detail hereinbelow.

Considering the compound displacement of only the pinion 14 more specifically, the number of teeth formed in the rack and in the pinion are chosen in the illustrative embodiment to cooperate with the pecularily formed transition notches 11*e* and 11*f* in the rack, and with the contoured flat portions 14*a* and 14*b* in the pinion, to effect precisely 180 degrees of angular rotation of the latter when driven along and beyond both ends of the intermediate section 11*a* of the rack with teeth.

It is apparent, of course, that the pinion could also be readily rotated a lesser or greater amount than 180 degrees by simply forming the rack and pinion with the proper number of teeth, and by forming the flat portions 14*a* and 14*b* of the pinion with the proper angle therebetween. In this regard, it is also appreciated that the degree of rotation of the pinion 14 is also dependent on the effective radius of the peripheral portion thereof with teeth. Should the rack and pinion be thus modified, it is seen that the pick-up arm 18 and vacuum cup 19 could be readily oriented at the same or different predetermined angles, relative to a vertical (or horizontal) plane, during the linear displacement of the pinion along either of the toothless rack sections 11*b* or *c*.

As previously pointed out, however, in order to rapidly and reliably extract diverse types of sheet stock from a releasable magazine, and to precisely position each such extracted sheet in a workholder, it is very desirous that the vacuum cup 19 not only be displaced linearly, but in a direction at least substantially perpendicular relative thereto, as illustrated. A more complete description of a typical sheet stock transfer operation carried out with the composite apparatus 10 will be given hereinbelow.

With specific reference again to FIGS. 1–3, it is seen that the rack 11 is supported in an upright or vertical position by, and between, upper and lower cross members 28 and 29 which, in turn, are secured to an upright support member 31. A vertically oriented support member 34 of triangular configuration is secured along a central region of the support member 31, with these members together comprising a composite frame that is secured to a stationary base or table 36.

The pinion assembly 12, including the specially constructed pinion 14, hollow shaft 16, pick-up arm 18 and vacuum cup 19, as previously described, are supported for controlled rotational and reciprocal displacement relative to the rack 11. This is accomplished by opposite end regions of the hollow shaft 16 being suitably journalled in respectively aligned bores 41 formed in and near the forward ends of a pair of laterally spaced, horizontally disposed support brackets 37 and 38. The opposite ends of the brackets are secured to a support block 44 which, in turn, is coupled to a retractable piston 48 of the previously identified pneumatic air cylinder 21. The latter is secured to both the upper cross member 28 and the vertical frame member 31. A pair of guide rods 52 and 53, each supported at opposite ends to the frame cross members 28 and 29, provide linear stability to the support block 44 and, hence, to the pinion 14, in particular, as it is reciprocally driven along the rack 11, while in continuous contact therewith.

Such reciprocal displacement of the pinion 14 is controlled by compressed air being sequentially supplied to the pneumatic cylinder 21 from an output port of an actuable spring-return type air valve 54, such as of the three-way type. To that end, and as illustrated, a source of compressed air (not shown) is supplied over a line 56 to the air valve 54, and from there over a line 57 to the pneumatic cylinder 21.

In the illustrative embodiment, the air valve 54 is operated in response to the angular position of a driven cam 58, which preferably is coupled to the drive source (not shown) of the associated indexable turret 27, when employed, so as to provide locked-in synchronous control over the sequential displacements of both the workholders 26 and the vacuum pick-up cup 19. It should be understood, however, that the cam 58 (or any other suitable control device) may be independently driven (or otherwise operated) in timed relation with the vacuum applied to the vacuum cup 19, and with the periodic advancement of indexable workholders, when employed, to effect the same desired operating results with equal effectiveness.

Vacuum is applied to the vacuum cup 19 in the following manner. Compressed air from a suitable source (not shown), which source may be the same one that is employed to operate the pneumatic cylinder 21, is directed through a line 62 to a conventional control valve 66, which may also be of the three-way type, and from the latter through a line 67 to a vacuum venturi device 68 (see FIG. 3). The resulting vacuum established in the latter device is drawn through a line 69 connected to an inlet end of a bore 16*a* in the shaft 16 that supports the pinion 14. As best seen in FIG. 2, the axially disposed bore 16*a* in the shaft 16 intersects and communicates with a short, centrally located, and radially disposed bore 16*b*. The latter bore is adapted to communicate with an axially disposed bore 18*a* in the pick-up arm 18 which, in turn, terminates in a central orfice 19*a* of the vacuum cup 19. By way of example only, one type of vacuum venturi device found to be particularly effective for use in establishing the necessary vacuum for the vacuum cup in the subject apparatus is sold by the Stilson Corp., under model No. VB-5625.

The timed periods during each sheet stock transfer cycle when vacuum is applied to the pick-up cup 19 are controlled by the actuation of the air valve 66. More specifically, the desired open (vacuum) and closed (no vacuum) operating states of this air valve are controlled by the use of upper and lower stop members 71 and 72 which are respectively secured to adjustable collars 73 and 74 mounted on opposite end regions of a retractable shaft 77 that forms part of the air valve 66. The stop members 71 and 72 respectively extend through slots 78 and 79 formed in the vertically oriented frame member 31 (seen only in FIGS. 1 and 3). A protruding stop detail 82, secured to the support block 44, is positioned to alternately engage the upper and lower stop members 71 and 72 in response to the support block being reciprocally driven along the guide rods 52 and 53 in response to the actuation of the pneumatic air cylinder 21 and, in particular, the upward and downward displacements of the piston 48 thereof.

In a typical sheet stock transfer application, the vacuum is normally applied to the vacuum cup 19 shortly before contacting the lowermost sheet 22 in the magazine 23, and is removed from the vacuum cup preferably just before positioning a given transferred sheet on the base of the aligned turret-supported workholder 26. Vacuum is removed from the vacuum cup 19 by the air valve 66 bleeding the air normally supplied thereto to the atmosphere, in a well known manner, such as through a conventional actuable bleeder orfice (not shown) formed therein. Considered more specifically, the bleeder orfice is opened in response to the retractable shaft 77 having been driven by the stop detail 82, mounted on the support block 44, downwardly to an orfice-opening position. Vacuum is again applied to the vacuum cup 19 when the stop detail 82 on the support block 44 is move upwardly until contacting the upper stop member 71 and, thereafter, displacing the latter a sufficient distance to cause the air valve shaft 77 to close the previously opened bleeder orfice in the air valve. With the stop members 71 and 72 being adjustably mounted on the air valve shaft 77, it is seen that the ON and OFF vacuum periods may be readily controlled for any given sheet stock transfer application.

It is to be understood, of course, that the vacuum applied to the vacuum cup 19 during the downward displacement thereof may actually be maintained until after each vacuum-held sheet 22 has contacted the base of the workholder 26, if desired. This may be readily accomplished by simply relying on the vacuum cup 19 exhibiting sufficient resiliency, or flexure, to allow the pneumatic cylinder piston 48 to continue moving downward before completing its extended stroke by an amount that will cause the air valve 66 to be actuated so as to remove the vacuum from the vacuum cup 19. This required additional downward displacement of the pneumatic cylinder piston 48, together with the air valve shaft 77, would normally present no problem, as the vacuum cup 19 is preferably made out of resilient material, such as of rubber. This latter mode of operation may be desired, or necessary, in situations where each successively transferred sheet 22 must be precisely positioned in a workholder or nest.

The unique sequence of linear-to compound linear and rotational-to linear displacement of the pinion 14 and, hence, of the pick-up arm 18 and vacuum cup 19 as supported on the associated hollow shaft 16, will now be considered in greater detail as employed to advantage in one illustrative sheet stock transfer application, with particular reference to FIGS. 4–7.

Figure 4:
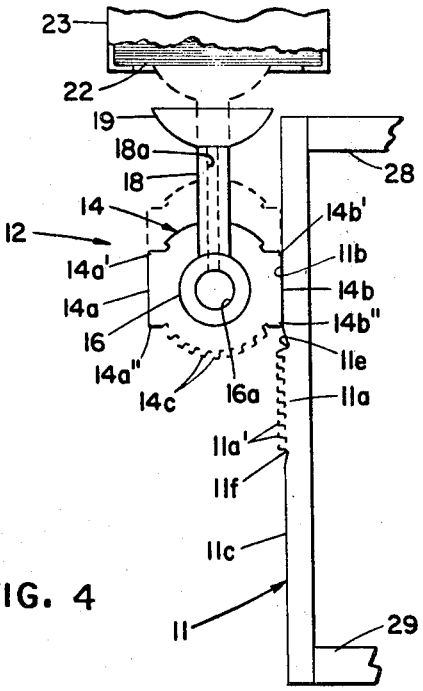

Starting with the upper peripheral edge of the vacuum cup 19 being at the elevated position shown in solid line form in FIG. 4, it is thereafter linearly displaced upwardly to the uppermost elevated position depicted in phantom line form in the same view. The magnitude of such upward linear displacement of the vacuum cup 19 is determined, of course, by the cam-controlled operation of the pneumatic cylinder 21 and, in particular, the controlled retracted stroke of the piston 48 thereof.

As previously noted, vacuum may be applied to the vacuum cup 19 at any time during the above-described upward linear displacement thereof, but normally is applied shortly before the vacuum cup contacts the lowermost sheet 22 then releasably confined within the magazine 23. It is the adjustable upper stop member 71, secured to the air valve retractable shaft 77, that determines when the vacuum is applied to the vacuum cup 19.

Figure 5:
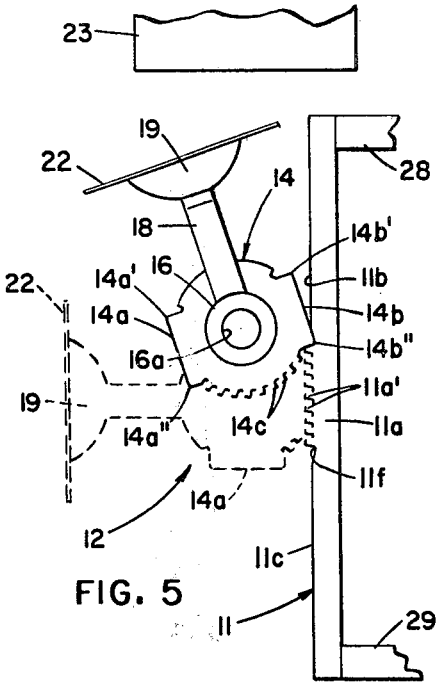

After the vacuum cup 19 has firmly gripped the lowermost sheet 22 in the magazine 23, the pneumatic cylinder 21 is again actuated under the control of the cam 58 to effect the downward displacement of the pneumatic cylinder piston 48 and, hence, of the composite pinion assembly 12, until the lowermost outer corner of the pinion flat portion 14*b*″ rocks into the upper cooperative transition notch 11*e* formed in the rack 11, as depicted in solid line form in FIG. 5. Thereafter, compound downward linear and counter-clockwise rotational displacement is imparted to the composite pinion assembly 12, together with the extracted sheet 22, resulting in that assembly passing through the position thereof depicted in phantom in FIG. 5, before reaching the position depicted in FIG. 6.

Figure 6:
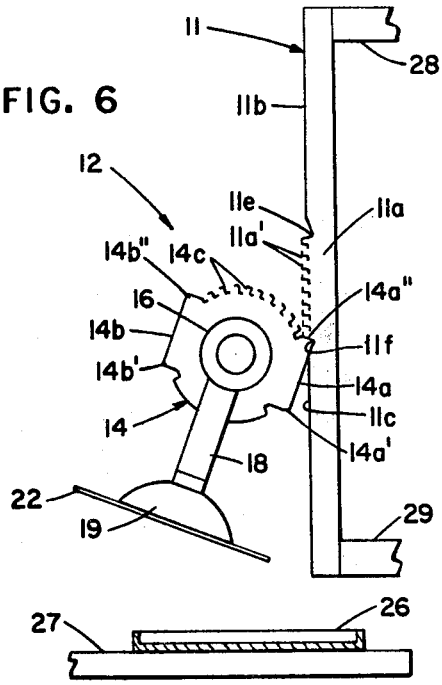
Figure 7:
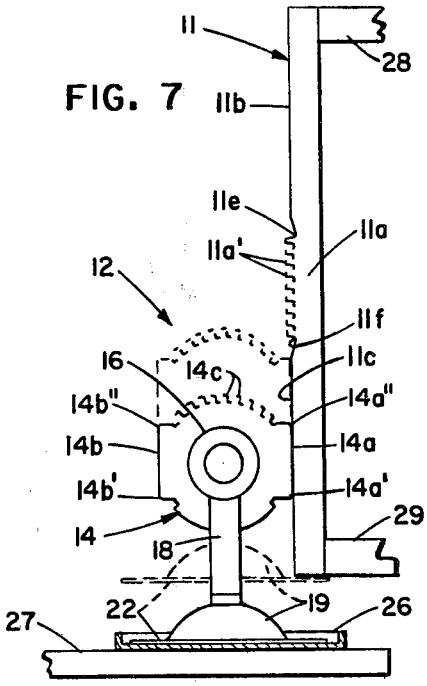

In the illustrative embodiment, approximately 110 degrees of angular counter-clockwise rotation is imparted to the pinion assembly 12 in moving from the position depicted in solid line form in FIG. 5 to the position depicted in FIG. 6. The actual magnitude of such rotation, as previously noted, is dependent on not only the number of mating teeth formed in the rack section 11*a* and in the pinion 14, but on the effective radius of that peripheral portion of the pinion with teeth.

Upon the pinion assembly 12 having been displaced by compound linear and rotational displacement to the position depicted in FIG. 6, the then uppermost outer corner 14*a*″ of the pinion flat portion 14*a* rocks into the lower transition notch 11*f* of the rack. Immediately thereafter, continued downward movement of the pinion assembly 12, as driven by the piston 48 of the pneumatic cylinder 21, results in the pinion flat portion 14*a* becoming firmly biased against the lower adjacent toothless section 11*c* of the rack, as depicted in phantom in FIG. 7.

From that point, the pinion assembly 12, with the pick-up arm 18 and vacuum cup 19 advantageously vertically oriented, is linearly displaced downwardly until the vacuum cup positions the then vacuum-held sheet 22 within the workholder 26. The magnitude of this latter downward linear displacement is again determined by the particular profile of the cam 58 that directly operates the air valve 54 and, in turn, the pneumatic cylinder 21. As previously described, the point in time at which vacuum is removed from the vacuum cup 19 is readily controlled by the selected positional securement of the lower stop member 72 on the retractable shaft 77, which forms part of the air valve 66.

Upon each successive magazine-extracted sheet 21 having been placed on the then aligned workholder 26, the pneumatic cylinder 21 is again actuated, in response to the angular position of the driven cam. This effects the retraction of the piston 48 and, hence, the upward displacement of the composite pinion assembly 12 until the then uppermost outer corner 14*a*″ of the pinion flat portion 14*a* again engages the lower transition notch 11*f* in the rack, as depicted in FIG. 6. Thereafter, compound linear and rotational displacement is imparted to the pinion assembly 12, but with rotation this time being of approximately 110 degrees in a clockwise direction, until the assembly is in the position depicted in solid line form in FIG. 5. From that position, the pinion assembly 12 continues to rotate clockwise, while simultaneously being driven upwardly, until acquiring the elevated position depicted in solid line form in FIG. 4, to commence a new cycle of operation.

While a preferred sheet stock transfer apparatus, incorporating a specially constructed composite rack and pinion assembly, has been disclosed herein, it is obvious that various modifications may be made to the present illustrative claimed embodiment of the invention, and that a number of alternative related embodiments could be devised by one skilled in the art without departing from the spirit and scope of the invention.

What is claimed is:

1. An apparatus for transferring piece parts from a dispensing station to a receiving station, said apparatus comprising:

means for releasably grasping a lowermost one of a stack of piece-parts when positioned at a dispensing station, and for positioning and releasing each such grasped piece-part at a receiving station, after having been transferred thereto;

means, connected to said grasping means, for reciprocally driving said grasping means sequentially along separate discontinuous linear paths of predetermined lengths while said grasping means approaches, arrives at, and is withdrawn from said dispensing and receiving stations, respectively, and for rotating said grasping means, and a piece-part when grasped thereby, along an arcuate path defined by a predetermined number of degrees of rotation while being transferred alternately from one of said linear paths to the other thereof;

said separate linear paths defined by said drive means, and along which said grasping means is sequentially driven, are co-linear, and separated by said arcuate transfer path, and wherein said rotation imparted to said grasping means by said drive means encompasses an arc of 180 degrees, thus effecting the complete inversion of a piece-part when transferred from said dispensing station to said receiving station by said releasable grasping means; and said drive means includes a specially constructed rack and pinion, each of the latter two elements being formed with specially contoured transition regions that selectively cooperate to impart linear-to compound linear and rotational-to linear displacement to said pinion and, in turn, to said connected piece-part grasping means, when the latter is driven from said dispensing station to said receiving station, and vice versa, by said drive means.

2. An apparatus in accordance with claim 1 wherein said grasping means includes a resilient vacuum cup, with vacuum generating and control means coupled thereto, and with the latter being responsive to a source of compressed air, when supplied thereto, for generating and sequentially applying a vacuum to said vacuum cup so as to allow the latter to grasp a piece-part, preferably when of sheet stock configuration and confined within a releasable magazine, at said dispensing station, and to remove said vacuum from said vacuum cup after such a grasped piece-part has been transferred to said receiving station.

3. An apparatus in accordance with claim 2 wherein said drive means further includes pneumatic cylinder means which, when supplied with a source of compressed air, sequentially effects the reciprocal driving of said pinion along said rack, and the sequential advancement of said vacuum cup along said linear and arcuate paths as controlled by the position of said pinion along said rack at any given time.

4. A sheet stock transfer apparatus for successively extracting the lowermost one of a stack of sheets when positioned at a dispensing station, and for thereafter transferring each such extracted sheet to, and releasing the latter at, a receiving station, said apparatus comprising:

a composite frame;

an elongated rack secured to said frame, said rack having an intermediate section formed with teeth and two opposite end toothless sections, said rack further having two specially contoured transition regions formed therein, each region being interposed between a different end of the intermediate section with teeth and the particular toothless section adjacent thereto;

rotatable pinion means including a peripherally segmented pinion, the latter having two spaced peripheral flat portions, with at least one array of rack-compatible teeth extending circumferentially along at least one of the two peripheral spaces defined between said two flat portions, each of said flat portions defining an outermost flat surface that protrudes beyond the radius that defines the crests of said array of teeth, and having circumferentially disposed and specially contoured outer corners that define transition regions that selectively cooperate with the transition regions of said rack so as to effect successive transitions from linear-to compound linear and rotational-to linear displacement of said pinion means when said pinion thereof is reciprocally driven along said rack;

support means mounted on said frame for rotatably supporting said pinion means;

drive means coupled to said support means for reciprocally driving the pinion of said pinion means along and in continuous contact with said rack, and pick-up means secured to said pinion means, said pick-up means being adapted to: (1) initially responsively grasp and extract the lowermost sheet of a stacked supply thereof, when positioned at the dispensing station, in response to said pinion of said pinion means being driven by said drive means to a predetermined position along a first one of said toothless rack sections, while one of said two flat pinion portions abuts thereagainst, (2) thereafter move an extracted sheet along a predetermined arc, in response to said pinion being driven along said intermediate rack section, while the teeth of the latter engage the teeth in said pinion, and (3) position and release each sheet when transferred from the dispensing station to the receiving station, in response to said pinion being driven to a predetermined position along the other of said toothless rack sections, while the other of said two flat pinion portions abuts thereagainst.

5. An apparatus in accordance with claim 4 wherein said means for reciprocally driving said pinion means comprises a pneumatic air cylinder, controlled by actuable air valve means when the latter is connected to a source of compressed air.

6. An apparatus in accordance with claim 4 wherein said pinion means includes an elongated shaft, with said pinion being secured to said shaft, and the latter being rotatably supported by said support means, and wherein said pick-up means includes a pick-up arm secured at one end to said shaft, and extending radially outward therefrom, with the opposite outer end of said pick-up arm having a sheet stock releasable grasping instrumentality secured thereto.

7. An apparatus in accordance with claim 6 wherein said means for reciprocally driving said pinion means comprises a pneumatic air cylinder, including a retractable piston, controlled by actuable air valve means when the latter is connected to a source of compressed air, and wherein said transition regions formed in said rack comprise specially contoured notches that are dimensioned to receive selected corners of said pinion flat portions as they are rocked into and out of said notches sequentially while said pinion is driven along said rack.

8. An apparatus in accordance with claim 7 wherein said support means for rotatably supporting said pinion means includes a reciprocally mounted, guide rod-guided support block, with bracket means secured thereto for rotatably supporting the shaft of said pinion means, and wherein the free end of said pneumatic cylinder piston is connected to said support block.

9. An apparatus in accordance with claim 6 wherein said sheet stock grasping instrumentality comprises a resilient vacuum cup, and wherein said pick-up means further includes vacuum generating and control means, responsive to a source of compressed air when supplied thereto, for generating and sequentially applying a vacuum to, and removing a vacuum from, said vacuum cup in timed relation with the driven reciprocal displacement of said pinion along said rack.

10. An apparatus in accordance with claim 8 wherein said sheet stock grasping instrumentality comprises a resilient vacuum cup, and wherein said pick-up means further includes vacuum generating and control means, responsive to a source of compressed air when supplied thereto, for generating and sequentially applying a vacuum to, and removing a vacuum from, said vacuum cup in timed relation with the driven reciprocal displacement of said pinion along said rack.

11. An apparatus in accordance with claim 10 wherein both said shaft of said pinion means and said pick-up arm of said pick-up means have axially disposed bores formed therein that communicate with each other, and with a central orfice formed in said vacuum cup, so as to allow a vacuum to be sequentially applied to said vacuum cup from said vacuum control and generating means through said hollow shaft and hollow pick-up arms.

12. An apparatus in accordance with claim 11 wherein said apparatus further includes a magazine adapted to releasably confine a supply of sheet stock positioned at the dispensing station.

13. An apparatus in accordance with claim 9 wherein both said shaft of said pinion means and said pick-up arm of said pick-up means have axially disposed bores formed therein that communicate with each other, and with a central orfice formed in said vacuum cup, so as to allow a vacuum to be sequentially applied to said vacuum cup from said vacuum control and generating means through said hollow hollow shaft and hollow pick-up arm.

14. An apparatus in accordance with claim 4 wherein said intermediate and opposite end sections of said rack are co-linear, and wherein the respective outermost flat surfaces defined by said pinion flat portions are mutually disposed on opposite peripheral sides of said pinion, and aligned in parallel, so that 180 degrees of rotation is imparted to said pinion in a given direction while being driven along said rack from one of said toothless end sections to the other thereof.

15. An apparatus in accordance with claim 13 wherein said intermediate and opposite end sections of said rack are co-linear, and wherein the respective outermost flat surfaces defined by said pinion flat portions are mutually disposed on opposite peripheral sides of said pinion, and aligned in parallel, so that 180 degrees of rotation is imparted to said pinion in a given direction while being driven along said rack from one of said toothless end sections to the other thereof.

* * * * *